US012654223B2

(12) United States Patent
Goushegir et al.

(10) Patent No.: US 12,654,223 B2
(45) Date of Patent: Jun. 16, 2026

(54) PRESSURE-SINTERING METHOD EMPLOYING DEFORMATION UPTAKE MEANS

(71) Applicant: Danfoss Silicon Power GmbH, Flensburg (DE)

(72) Inventors: Mohammad Goushegir, Flensburg (DE); Martin Becker, Kiel (DE); Ralf Kalischko, Flensburg (DE); Fernando Sanchez, Flensburg (DE)

(73) Assignee: DANFOSS SILICON POWER GMBH, Flensburg (DE)

( * ) Notice: Subject to any disclaimer, the term of this patent is extended or adjusted under 35 U.S.C. 154(b) by 3 days.

(21) Appl. No.: 18/609,294

(22) Filed: Mar. 19, 2024

(65) Prior Publication Data

US 2024/0316638 A1 Sep. 26, 2024

(30) Foreign Application Priority Data

Mar. 21, 2023 (DE) ..... 102023107033.9

(51) Int. Cl.
*B22F 7/06* (2006.01)
*B22F 3/16* (2006.01)

(52) U.S. Cl.
CPC ..... *B22F 7/064* (2013.01); *B22F 3/168* (2013.01); *B22F 2998/10* (2013.01)

(58) Field of Classification Search
None
See application file for complete search history.

(56) References Cited

U.S. PATENT DOCUMENTS

| | | | | |
|---|---|---|---|---|
| 8,118,211 | B2 * | 2/2012 | Eisele | H01L 23/3735 228/180.1 |
| 11,257,735 | B2 * | 2/2022 | Yamasaki | H01L 23/46 |
| 2013/0032230 | A1 | 2/2013 | Olesen et al. | |
| 2015/0016064 | A1 | 1/2015 | Yamamoto et al. | |
| 2019/0373777 | A1 | 12/2019 | Wecker et al. | |
| 2021/0013175 | A1 * | 1/2021 | Osterwald | H01L 23/3735 |
| 2022/0059426 | A1 * | 2/2022 | Kappauf | H01L 21/4882 |

FOREIGN PATENT DOCUMENTS

| | | | | |
|---|---|---|---|---|
| CN | 110192442 | A | 8/2019 | |
| CN | 111902931 | A | 11/2020 | |
| DE | 10 2017 101 126 | A1 | 7/2018 | |
| EP | 2559063 | A1 | 2/2013 | |
| EP | 2 559 063 | B1 | 5/2018 | |
| JP | 2011238644 | A | 11/2011 | |
| JP | 5776328 | B2 | 9/2015 | |
| JP | 6080929 | B2 | 2/2017 | |
| KR | 20190046347 | A * | 5/2019 | H10P 72/0431 |
| WO | 2011127931 | A1 | 10/2011 | |
| WO | WO-2020127443 | A2 * | 6/2020 | |
| WO | 2020254143 | A1 | 12/2020 | |
| WO | WO-2021038688 | A1 * | 3/2021 | H01L 25/07 |
| WO | WO-2022218906 | A1 * | 10/2022 | H01L 21/4882 |

* cited by examiner

*Primary Examiner* — Devang R Patel
(74) *Attorney, Agent, or Firm* — McCormick, Paulding & Huber PLLC

(57) ABSTRACT

A method for fixing an attachment object to a side of a patterned object comprising a plurality of protrusions with tip portions, by pressure-sintering. A deformation uptake means made of a material having a lower yield strength and/or a lower hardness than the tip portions, is arranged between the patterned object and at least a fraction of the tip portions.

15 Claims, 3 Drawing Sheets

PRESSURE-SINTERING METHOD EMPLOYING DEFORMATION UPTAKE MEANS

CROSS-REFERENCE TO RELATED APPLICATION

This application claims foreign priority benefits under 35 U.S.C. § 119 from German Patent Application No. 102023107033.9, filed Mar. 21, 2023, the content of which is hereby incorporated by reference in its entirety.

TECHNICAL FIELD

The invention relates to a method for fixing an attachment object, for example a semiconductor power module, to a patterned object by pressure-sintering, e.g. to a heat dissipator, heat sink, and/or (a part for) a cooler.

BACKGROUND

The method is applicable in the manufacturing of power module assemblies. Such a power module assembly (in the following referred to as "assembly") can include several attachment objects that are fixed to the patterned object. Typically, the assembly is configured to form part of an electric circuit, e.g. a drivetrain circuit of an electric vehicle. The demand for electric vehicles, especially for electric cars, is currently rapidly increasing.

Power modules, and especially those formed as attachment objects, are adapted to exhibit the required electric functionalities. At least some of such attachment objects may be semiconductor power modules. Those may include insulated-gate bipolar transistors (IGBTs) and/or metal-oxide-semiconductor field-effect transistors (MOSFETs).

In operation of the electric circuit, the attachment objects generate heat, especially due to electric currents. In order to avoid overheating and damage of the attachment objects, they are fixed to the patterned object. Often, the patterned object is a heat dissipator with protrusions for cooling, e.g. with oblong fins/ribs or with pin fins (cooling fins), or walls forming coolant channels. The patterned object receives a considerable part of the heat generated by the attachment objects and dissipates it further. For example, the patterned object further releases the heat to environmental air via the cooling fins. The attachment objects should be fixed to the patterned object in a manner allowing sufficient heat transfer from the attachment objects to the patterned object.

According to a traditional approach, the attachment objects are fixed to the patterned object by soldering.

However, on the one hand, large electric powers have to be transferred and controlled by the attachment objects. This involves considerable heat generation. On the other hand, there is an ongoing tendency to decrease the size of the attachment objects, e.g. the individual semiconductor power modules. Consequently, the contact areas between the attachment objects and the patterned object that can transfer heat are decreased. The attachment objects and solder layers fixing the attachment objects to the patterned object tend to reach higher temperatures during operation. If one of the solder layers becomes too hot during operation, it starts to melt again. The attachment object is no longer fixed to the heat dissipator. This results in mechanical failure of the assembly. Moreover, the heat transfer to the heat dissipator is impaired as soon as the solder layer melts away. The attachment object can overheat. This results in electric failure of the assembly.

As an alternative, the attachment object can be fixed to the patterned object by pressure-sintering. In more detail, a sintering material is provided between the attachment object and the patterned object. Then, the sintering material is subjected to a solidification step. The patterned object is arranged at a first tool side and the attachment object is arranged at a second tool side in a pressure-sintering tool. The sintering material is heated to an elevated sintering temperature. In addition, the attachment object and the patterned object are pressed together along a normal direction by placing the attachment object and the patterned object between the two sides of the pressure-sintering tool which applies a normal force. The solidification step densifies and solidifies the sintering material. As a result, a sinter layer is formed between the attachment object and the patterned object from the sintering material. Compared to the solder layer, the sinter layer is less prone to be damaged by high temperatures and/or high heat release from the attachment object during operation. This reduces the risk of mechanical and electrical failure of the assembly.

However, fixing the attachment object to the patterned object by pressure-sintering instead of by soldering is more difficult and expensive. On the one hand, a thickness of the sinter layer should be low in order to allow good heat transfer from the attachment object to the patterned object. On the other hand, it must be ensured that the sinter layer extends uniformly between the patterned object and the attachment object. Thickness variations and voids in the sinter layer significantly reduce the heat transfer and the mechanical stability, at least locally.

Hence, the patterned object must be manufactured with very demanding (manufacturing) tolerances. Only a very small tolerance regarding a protruding length of the protrusions along the normal direction is acceptable. The protrusion lengths of all protrusions must be at least substantially the same. It has been shown that a cost-efficient manufacturing of the patterned object is possible by forging, for example by stamp forging. This allows cost-efficient and quick mass production, but may result in protrusions which do not have lengths which are substantially the same. Thus, the protrusions have to be milled down after stamp forging in order to achieve the required small tolerance regarding the protrusion length. This increases the complexity, and thus cost, of the manufacturing process.

In the following, it is described what happens if the tolerance regarding the protruding length is not small enough. The individual protrusion lengths of the protrusions will considerably differ. The protrusion lengths may be measured along the normal direction. The tolerance of the protrusion lengths constitutes a "height tolerance" (i.e. a tolerance along the normal direction).

Some of the protrusions have a particularly large protrusion length ("longest protrusions"). In the solidification step, only tip portions of the longest protrusions abut the first tool side. Shorter protrusions do not engage the first tool side at all during the whole solidification step. Gaps remain between the first tool side and the tip portions of the shorter protrusions.

Thus, only the longest protrusions transfer pressure (force) along the normal direction between the first tool side and the rest of the patterned object. The first tool side is strong and rigid and will not significantly yield. Instead, local deformations and stress peaks within the patterned object occur. In addition, the longest protrusions are in general not uniformly distributed. As a result, the pressure is not uniformly applied to the sintering material. The thickness of the resulting sinter layer will vary. Further, the non-uniform application of pressure and the uncontrolled variations in thickness within the sinter layer increase the risk of mechanical failures and non-uniform heat transfer from the attachment object to the patterned object. For example, there is an increased risk that cracks and/or voids occur in areas of the sinter layer that are in-line with the longest protrusion along the normal direction. Cracking and void formation might already happen directly after the solidification step. The local deformations and stresses in the patterned object decrease when the pressure-sintering tool does not apply the pressure any longer. The mechanical relaxation of the patterned object imposes local stresses and strains onto the sinter layer as the shape of the patterned object now deviates from its shape during the solidification step. If the attachment object is a semiconductor power module, e.g. a molded module, it may include a direct bonded copper (DCB) structure with a ceramic substrate. Local stress peaks during the solidification step and/or mechanical relaxation after the solidification step may also cause cracks in the ceramic substrate. This can result in isolation failure.

Apart from that, other height tolerances (i.e. tolerances along the normal direction) may impair the quality of the sinter layer. This risk is particularly high if several attachment objects become fixed to the same patterned object in the same solidification step, for example at different contact areas distanced from each other. Such other height tolerances may include, for example, height tolerances of the attachment objects, e.g. molded modules, and/or of the sintering tools. According to an aspect, it is possible that the first tool side and/or the second tool side are not completely flat. For example, there may be local height variations due to damage or dirt adhesion. Similar as the tolerance regarding the protrusion lengths, other height tolerances can lead to variable sintering quality, cracks of the ceramic substrate and isolation failure.

The risks of problems further increase with larger sintering areas and with more attachment objects.

SUMMARY

The problem underlying the invention is how to ensure good sintering quality while allowing a cost-efficient manufacturing of the patterned object.

This problem is solved by a method for fixing an attachment object to a patterned object by pressure-sintering according to claim 1.

In the inventive method for fixing the attachment object to the patterned object by pressure-sintering, the attachment object becomes fixed to an attachment side of the patterned object, wherein the patterned object comprises a patterned side facing away from the attachment side, the patterned side including a plurality of protrusions with tip portions.

The method includes (the steps of):

- providing a sintering material between the attachment object and the attachment side of the patterned object;
- arranging the patterned object and the attachment object in a pressure-sintering tool, wherein the patterned object is arranged at a first tool side of the pressure-sintering tool and the attachment object is arranged at a second tool side of the pressure-sintering tool;
- arranging an additional deformation uptake means between the first tool side and at least a fraction of the tip portions, wherein the deformation uptake means is made of a deformation material having a lower yield strength and/or a lower hardness than (at least) the tip portions;
- a solidification step including pressing the patterned object and the attachment object towards each other (e.g. by the pressure-sintering tool) for densifying the sintering material and applying heat to the sintering material, thereby sintering the sintering material and forming a sinter layer between the attachment side and the attachment object.

In the solidification step, the patterned object and the attachment object may be pressed towards each other along a normal direction. In one embodiment, the attachment object becomes fixed at an attachment area on the attachment side, wherein the attachment area is flat. Especially, the whole attachment side may be flat. The normal direction may be perpendicular to the attachment side, at least to the attachment area.

In the solidification step, the sintering material is pressed between the attachment side of the patterned object and the attachment object. The attachment object, the patterned object, and the sintering material in-between are squeezed together between the first tool side and the second tool side. In addition, the sintering material is heated to an elevated sintering temperature. The solidification step densifies and solidifies the sintering material, thereby forming a sinter layer between the attachment object and the patterned object from the sintering material. As a result, the attachment object is permanently fixed to the patterned object by the sinter layer.

An assembly produced by the method includes the patterned object, the sinter layer, and the attachment object fixed to the patterned object by the sinter layer.

The method disclosed herein allows that the patterned object is manufactured with comparatively large (manufacturing) tolerances, especially with regard to the protrusion. In more detail, a large (manufacturing) tolerance regarding a protruding length of the protrusions along the normal direction is acceptable. The individual protrusion lengths of the protrusions are allowed to differ.

The method is a simple and cost-efficient method to compensate height tolerances in the system for sintering (the pressure-sintering tool with the attachment object, the sintering material, and the patterned object), especially also for large area sintering.

In the solidification step, the tip portions of the protrusions face the first tool side. A force for pressing the patterned object and the attachment object towards each other (e.g. along the normal direction) must be transferred from the first tool side to the rest of the patterned object via the deformation uptake means and (at least some) of the protrusions.

Along the normal direction, the uptake deformation means is arranged between the protrusions and the first tool side in the solidification step. The deformation uptake means shields the protrusions against the first tool side. As noted above, the first tool side is comparatively rigid and non-yielding. Especially, the deformation material may have a lower yield strength and/or hardness than the first tool side (a material at the first tool side).

At first, only the tip portions of the longest protrusions of the fraction abut the deformation uptake means. In other words, engagement between the protrusions and the uptake deformation means starts with the longest protrusions.

As the deformation material has the lower yield strength and/or the lower hardness than (at least) the tip portions, the deformation uptake means yields at engagement areas with the tip portions of the longest protrusions of the fraction when the pressure is increased. Said tip portions (at least partially) plunge into the deformation uptake means. As a consequence, the deformation uptake moves relative to the patterned object farther, along the normal direction, towards the attachment side. The tip portions of further protrusions (which also belonging to the fraction overlapped by the deformation uptake means) additionally come into direct contact with the deformation uptake means. Therefore, with increasing pressure, an increasing number of the protrusions takes part in the force transfer between the first tool side and the rest of the patterned object. The risk of excessive local deformations and stress peaks in the patterned object due to excessive load transfer via only the few longest protrusions is reduced. The pressure is applied more uniformly onto the sintering material. The sinter layer becomes more uniform. This facilitates making the sinter layer particularly thin. Finally, the risk of the occurrence of cracks and/or voids in the sinter layer is reduced. This improves the manufacturing yield and the reliability of the assembly.

The sinter layer being particularly thin and uniform enhances the heat conduction from the attachment object to the patterned object. This is beneficial for the dissipation of heat generated by the attachment object during operation, e.g. in an electric circuitry, via the patterned object.

According to one aspect, the deformation uptake means may be made of a deformation material having the lower yield strength and/or the lower hardness than the protrusions. In other words, the lower yield strength and/or the lower hardness does not only apply with regard to (at least) the tip portions but with regard to the complete protrusion.

According to one aspect, an interface side of the attachment object may become fixed to the attachment side of the patterned object via the sinter layer. The interface side of the attachment object faces towards the attachment side. An opposite side of the attachment object may be referred to as "tool-facing side" of the attachment object. This tool-facing side may face the second tool side in the solidification step. In particular, it may directly abut the second tool side in the solidification step.

The sintering material may be applied to the contact area at the attachment side and/or to the interface side in an application step. The application step may be performed before the attachment object is placed on the attachment side with the sintering material in-between.

The sintering material may include a sintering paste and/or a sintering pad.

For example, a layer of sintering paste may be applied to the attachment side of the patterned object. The attachment object may be placed onto the layer of sintering paste.

Alternatively or additionally, the sintering pad maybe provided between the attachment object and the attachment side of the patterned object. For example, the sintering pad may be placed onto the attachment side at the contact area for fixing the attachment object.

The sintering material may include metallic particles and at least one volatile component. The metallic particles may include or be silver particles, copper particles, and/or gold particles. The volatile component may be organic. A density of the sintering material may be in the range from 2.5 g/cm$^3$ to 3.5 g/cm$^3$.

The sintering material (the sintering paste and/or the sintering pad) may be pre-dried. Especially, the method may include a step of pre-drying the sintering material, e.g. after the application and before placing the attachment object onto the attachment side with the sintering material in-between. At least a part of the volatile organic component(s) may evaporate during the pre-drying. The sintering material may be applied in a wet state in the application step before the pre-drying.

The attachment object may be placed onto the pre-dried sintering material. The solidification step may be performed with the pre-dried sintering material.

The method may include an insertion step, in which a collocation including the patterned object, the attachment object, and the sintering material are inserted into the sintering tool. A handling means, e.g. a frame, may be employed for handling the collocation and/or for ensuring a predetermined position of the assembly (and its parts) in the sintering tool.

Disclosures relating to "the attachment object" and its fixation to the patterned object may individually refer to one of, several, or all of the attachment objects, respectively. Each attachment object may be fixed according to any one of the approaches disclosed herein. The fixation of different attachment objects may include different modifications according to the present disclosure. For example, a first attachment object may be fixed employing the sintering paste, and a second attachment object may be fixed employing a sintering pad. Preferably, the fixation of the several attachment objects is performed with the same solidification step. According to one aspect, all attachment objects can be fixed to the patterned object in the same manner. The attachment objects may be positioned distanced from each other in the assembly (and accordingly in the collocation).

The disclosed method facilitates to achieve a homogenous pressure on the sinter layer at the different contact areas for the different attachment objects. Accordingly, this helps to achieve a homogenous pressure on all the individual attachment objects in the solidification step. It is also avoided that an attachment object having a higher thickness and/or overlapping with particularly many longest protrusions is damaged due to excessive force transfer between the second tool side and the sintering material.

The sintering material provided between the patterned object and the attachment object(s) may be referred to as "sintering layer" before the solidification step. A thickness of the sintering layer (along the normal direction) may be in the range from 80 μm to 200 μm, e.g. 150 μm V, wherein V may be 10 μm or 6 μm.

According to one aspect, the solidification step may include heating up (at least) the sintering material in the pressure-sintering tool to an elevated sintering temperature. The elevated sintering temperature may be in a sintering temperature range from 200° C. to 300° C. Heat may be applied from the first tool side and/or from the second tool side. Especially, more heat or all of the heat can be applied from the first tool side. This is beneficial because a heat conduction of the patterned structure may be higher than a heat conduction of the attachment object. Furthermore, the attachment object may be more prone to be damaged by high temperatures than the patterned object.

According to a further aspect, the solidification step may include applying pressure onto the sintering material in a sintering pressure range from 10 MPa to 40 MPa, in a modification from 15 MPa to 30 MPa. The forces needed for pressure application may be applied from the first tool side and the second tool side.

In the solidification step, the temperature may be kept in the sintering temperatures range and/or the applied pressure may be kept in the sintering pressure range for a duration in a range from 2 minutes to 10 minutes.

The solidification step transforms the sintering material (the sintering layer) to the sinter layer.

As noted above, the method includes arranging the (additional) deformation uptake means between the first tool side and at least the fraction of the tip portions. This may mean that, seen in a projection along the normal direction, the deformation uptake means overlaps with at least the fraction of the tip portions.

The deformation uptake means is provided in addition to the patterned object and the first tool side. The deformation uptake means may be separated from the assembly after the solidification step. In other words, the deformation uptake means does not form part of the assembly.

The patterned object may be larger than the attachment object. In particular, an area of the attachment side may be larger than an area of the interface side. For example, the area of the attachment side can be at least three times the area of the interface side. This allows fixing several attachment objects to the attachment side. Furthermore, the patterned object has a larger surface. This facilitates the heat release via the patterned object.

According to one aspect, an area size of the patterned object (in a projection to a plane that is perpendicular to the normal direction) may be at least 6 $cm^2$, e.g. at least 12 $cm^2$. This allows for a good heat dissipation.

According to one aspect, an area size of the sinter layer between the attachment object and the patterned object might be at least substantially the same as an area size of the interface side. For example, the area size of sinter layer might deviate by 25% from the area size of the corresponding interface side at the maximum. Typically, the sinter layer is a bit larger than the area size of the corresponding interface side. In the solidification step, the sintering material is squeezed between the attachment object and the patterned object. Accordingly, an area size of the sintering layer can be smaller than the area size of the sinter layer.

In one embodiment, a thickness of the sinter layer is 70 μm at the maximum. Additionally or alternatively, the thickness of the sinter layer may be at least 20 μm. The thickness of the sinter layer can be 50 μm W. W may be 10 μm or 6 μm, for example. A density of the sinter layer may be higher than a density of the former sintering layer. The thickness of the sinter layer may be smaller than a thickness of the former sintering layer. The sinter layer may be made of at least 90 weight-%, maybe at least 96 weight-%, of metal, e.g. resulting from a metallic material proportion of the sintering material. The density of the sinter layer can at least substantially correspond to a density of the metallic material proportions of the sintering material.

Naturally, the method may include fixing several attachment objects, for example at least two attachment objects, to the patterned object by pressure-sintering.

Fixing several attachment objects to the same patterned object allows to increase the power density and saves installation space in a final product, e.g. an electric vehicle. Furthermore, using the same patterned object (e.g. heat dissipator, heat sink, and/or a part for a cooler) for dissipating the waste heat of several attachment objects helps in reducing a weight of the electric circuit and hence a weight of the final product.

According to one aspect, the method further includes plastically deforming the deformation uptake means locally by pressing the deformation uptake means (e.g. flat) against the patterned object at its patterned side. Plastically deforming the deformation uptake means may be performed during the solidification step and/or an adaption step preceding at least the solidification step. Said plastic deformation may be performed specifically at the engagement areas of the deformation uptake means with at least some of the tip portions (including e.g. tip portions of the longest protrusion being part of the above-mentioned fraction of the tip portions). This limits the pressure (force) transfer via the longest protrusions.

The plastic deformation starts at the engagement areas with the tip portions of the longest protrusions which are part of the fraction. After the plastic deformation has started, further local force transfer increase is limited in these engagement areas, even if a global force transfer between the first tool side (via the deformation uptake means) and the rest of the patterned object increases further. Where the plastic deformation has started, further displacement of the patterned object towards the first tool side results in that the corresponding tip portions plastically plunge deeper into the deformation uptake means. The deformation material plastically yields in these engagement areas, wherein the deformation material plastically flows away at the corresponding tip portions. This ensures an at least basically constant pressure transfer via all those protrusions where plastic flow of the deformation uptake means has initiated.

Tests with pressure-sensitive foil between the deformation uptake means and the patterned side of the patterned object have revealed that there is a homogenous pressure in all engagement areas with plastic deformation.

As the patterned object is meanwhile displaced further along the normal direction towards the first tool side and as the longest protrusions of the fraction plunge deeper into the deformation uptake means, more and more shorter protrusions come into engagement with the deformation uptake means and contribute to the force transfer between the first tool side (via the deformation uptake means) and the rest of the patterned object.

Firstly, this decreases the risk that the sintering quality is impaired by excessive load transfer via the longest protrusions only. Secondly, as more and more shorter protrusions of the fraction take part in the force transfer when the attachment object and the patterned object are pressed stronger together, a global variance of the pressure application onto the sintering material is reduced. As more and more shorter protrusions of the fraction contribute to the force transfer, a statistical variation of the protrusion lengths becomes more and more irrelevant. Hence, both the risks of local variations of the thickness of the sinter layer (e.g. due to local deformation of the patterned object) and global variations of the thickness of the sinter layer are reduced. This facilitates manufacturing a particularly thin but uniform sinter layer, which is beneficial for good heat transfer and high reliability.

As noted above, plastically deforming the deformation uptake means may be performed during the solidification step. This allows adaption of the deformation uptake means to the height tolerances directly within solidification step. The forces applied for sintering the sintering material is automatically used, in a synergistic manner, for said adaption. This reduces the complexity, duration, and costs of manufacturing. Further, it allows to compensate additional height tolerances, e.g. regarding the thicknesses of the attachment objects. Preferably, plastically deforming the deformation uptake means in the described manner is performed only during the solidification step.

Additionally or alternatively, plastically deforming the deformation uptake means in the described manner may be performed in the adaption step preceding the solidification step. In particular, this can be performed even before the sintering material is applied to the attachment surface. This allows pressing the protrusions with the tip portions against the deformation uptake means with high temperature and/or under harsh environmental conditions without damaging the attachment object and/or the sintering material. The adaption step may be performed in the sintering tool or in a separate tool. With specific regard to the separate adaption step only, plastically deforming the deformation uptake means might also include melting and/or softening (e.g. heating above a glass-transition temperature) the deformation uptake means for facilitating the adaption to the shapes of the protrusions.

According to one aspect, the deformation uptake means prevents the tip portions (especially those of the longest protrusions) from directly abutting the first tool side during the whole solidification step. In other words, the yield strength and/or the hardness of the deformation uptake means is/are sufficiently high that (even) the longest protrusions do not completely push through the deformation uptake means. This avoids excessive pressure transfer (force transfer) via the longest protrusions, e.g. in a later part of the solidification step.

A melting point (or glass-transition temperature) of the deformation material may be higher than the elevated sintering temperature, for example by at least 5% (in Kelvin scale). This avoids that the deformation uptake means becomes too liquid during the solidification step.

According to one aspect, indications regarding the yield strength and the hardness may, respectively, relate to one of, several of, or all of the following temperatures:

room temperature, the elevated sintering temperature, and an adaption temperature in the adaption step (if any).

Especially, they can relate at least to the elevated sintering temperature.

According to one aspect, the method includes plunging at least 20%, e.g. at least 20 number-% and/or 20 area-%, (in a modification at least 60% or at least 95%) of the tip portions into the deformation uptake means causing local plastic deformation of the deformation uptake means during the solidification step and/or the adaption step preceding the solidification step, by pressing the deformation uptake means (e.g. flat) against the patterned object at its patterned side. This feature might be referred to as "deformation criterion".

Similar as mentioned above, said local plastic deformation may be performed specifically at the engagement areas of the deformation uptake means with at least some of the tip portions of the protrusions of the fraction.

The deformation criterion ensures that the tip portions of at least a corresponding percentage of the tip portions properly engage the deformation uptake means and fully contribute to the pressure transfer (force transfer) between the first tool side, via the deformation uptake means, and the rest of the patterned object.

For example, the deformation criterion may relate to number-% of the tip portions. Especially, the percentage may relate to a number of concerned ones of the tip portions (i.e. those of the tip portions causing plastic deformation as described above) compared to a total number of the tip portions (i.e. to a number of all the tip portions).

Additionally or alternatively, the deformation criterion may relate to area-%. The area-% may indicate what proportion of summed-up cross-sectional areas of all the tip portions causes plastic deformation in the deformation uptake means in one method cycle. Said cross-sectional areas may be perpendicular to the normal direction, along which the deformation uptake means and the patterned object are pressed together during the adaption step and/or the solidification step.

A method cycle may include (only) one solidification step and, if any, the corresponding previous adaption step.

In more detail, one exemplary possibility of determining the area-%, e.g. a value 'R', may include or consist of the following:

a) Determining an area $A_{p1}$ by summing up cross-sections of openings of all indentations in the deformation uptake means, which were formed by plastic deformation by those of the tip portions having plunged into the deformation uptake means during one single method cycle.

b) Determining a reference value $A_{ref}$ by calculating or measuring a sum of the cross-sectional areas of all of the tip portions. It may be sufficient to consider an ideal patterned object without tolerances (e.g. with identical protrusions lengths of all protrusions) for the calculation. The cross-sectional areas can be calculated/measured in a plane perpendicular to the normal direction in a position where all of the tip portions of the fraction are plunged into the deformation uptake means by at least 40 μm.

c) $'R' = A_{pl} / A_{ref} \cdot 100\%$

As indicated above, the deformation criterion may optionally relate to not only at least one of but to both of the corresponding number-% and area-% definitions. According to this aspect, the deformation criterion is fulfilled only if it applies in terms of both corresponding definitions.

According to another aspect, the fraction of the tip portions may correspond to at least 50%, in a modification at least 70% or at even at least 95%, of all of the tip portions. This can be referred to as "fraction criterion" and the concerned percentage might be referred to as "fraction percentage" or "overlap percentage". The fraction criterion ensures that a considerable proportion of the tip portions has, in principle, a chance to engage with the deformation uptake means for force transfer. If the force is high enough, all tip portions of the fraction finally directly engage with the deformation uptake means.

The overlap percentage may relate to number-%. For example, it may be a ratio (in %) of a number of those tip portions, with which the deformation uptake means overlaps (seen in a projection onto a plane perpendicular to the normal direction), and the total number of the tip portions.

Alternatively or additionally, said fraction percentage may relate to area-%. Especially, it may indicate with what proportion of the sum of the cross-sectional areas of all of the tip portions (see e.g. bullet b) some paragraphs above) the deformation uptake means overlap.

As indicated above, the fraction criterion may optionally relate to not only at least one of but to both of the corresponding number-% and area-% definitions. According to this aspect, the fraction criterion is fulfilled only if it applies in terms of both corresponding definitions.

According to one aspect, a yield strength of the deformation material is at the most 800%, e.g. at the most 60%, of the yield strength of the protrusions. This guarantees that no plastic deformation of the protrusions occurs in the adaption step and/or the solidification step.

The yield strength of the protrusions may correspond to a protrusion material from which the protrusions are made. If the protrusions include different sections which are made of different materials (e.g. protrusions with a coating), the yield strength of the protrusion may refer to any one of a yield strength of a main material of the protrusions (e.g. the protrusions may be made of the main material and be coated with the coating), an effective yield strength the protrusions as a whole, and a lowest yield strength exhibited by said different materials.

According to a further aspect, a hardness of the deformation material is at the most 80%, e.g. at the most 60%, of a hardness of the tip portions. This prevents that the tip portions are damaged due to the engagement with the deformation uptake means, especially by plunging into the deformation uptake means.

In one embodiment, the deformation material has a thermal conductivity of at least 30 W/(m·K). This facilitates heating the sintering material from the first tool side via the deformation uptake means and the patterned object in the solidification step. A high heat conduction of the deformation uptake means is beneficial for fast, reliable, and efficient sintering of the sintering material in the solidification step.

The deformation uptake means may include a metal sheet. Especially, the deformation uptake means may consist of a single metal sheet. In one embodiment, the deformation uptake means may include (or consist of) several metal sheets. A number of the metal sheets can be the same as a number of the attachment objects. Metal sheets are cheap, easily available, and easy to recycle. Furthermore, metal sheets typically exhibit a good heat conduction. In addition, they can withstand the elevated sintering temperature without chemical decomposition and without melting.

In one embodiment, the deformation material is pure aluminum. Pure aluminum may mean aluminum with a purity of at least 99 weight-%. Such pure aluminum exhibits a yield strength and hardness that are, on the one hand, low enough such that the tip portions can plunge into the deformation uptake means including local plastic deformation of the deformation uptake means. As explained above, this ensures that even in the case of considerable height tolerances not only the longest protrusions are employed for pressure transfer but at least some of the shorter protrusions of the fraction engage the deformation uptake means as well during the solidification step. On the other hand, the yield strength and hardness are high enough such that the tip portions of the longest protrusions of the fraction cannot easily penetrate completely through a whole thickness of the deformation uptake means in the solidification step.

As an alternative, the deformation material can be gold, e.g. pure gold. As a further alternative, the deformation material can be lead. Gold and lead are, respectively, soft enough for allowing plastic deformation but exhibit enough mechanical resistance such that the longest protrusions of the fraction do not penetrate completely through the deformation uptake means during the solidification step.

According to still another aspect, the deformation uptake means can be made of at least one engineering polymer. The engineering polymer should be chemically stable at the elevated sintering temperature, preferably in the whole sintering temperature range. For example, the deformation uptake means can be made of polyether ether ketone (PEEK) and/or polyphenylene sulfide (PPS). The deformation uptake means can include additional fillers and/or fiber-reinforcements. However, deformation uptake means made of engineering polymers are more expensive than deformation uptake means made of pure aluminum, for example.

According to another aspect, the yield strength of the deformation material is at least 8 MPa. This reduces the risk that the tip portions of the longest protrusions of the fraction penetrate completely through the deformation uptake means in the adaption step and/or in the solidification step.

As noted above, the elevated sintering temperature may be in the range from 200° C. to 300° C. The deformation material may be (chemically) stable at the elevated sintering temperature. This prevents manufacturing errors resulting from chemical decomposition of the deformation uptake means during the solidification step.

In one embodiment, at least cores of the protrusions are made of copper and/or aluminum. This includes alloys based on copper and/or aluminum. Additionally or alternatively, the protrusions may have a coating, e.g. a nickel coating (including nickel alloys). For example, the protrusions may be made of an aluminum alloy exhibiting a higher yield strength and hardness than the deformation material. As another example, the protrusions are made from copper (including copper alloys) as the main material, wherein the protrusion are (at least partially) coated with nickel (including nickel alloys). The coating protects the cores from corrosion, e.g. due to the contact with a coolant. Accordingly, the protrusions may be at least substantially made of copper, aluminum, and/or nickel.

In one exemplary embodiment, the patterned object with the protrusions is made of aluminum (including aluminum alloys) and comprises an inlay made of copper (including copper alloys) at the attachment side, e.g. matching with the attachment area and being by at least 25% larger than the attachment area.

As the inlay exhibits a particularly high heat conduction, the heat originating from the attachment object and taken up by the patterned object during operation at the attachment area is very effectively pre-distributed within the patterned object by the inlay. In addition, fixation by sintering with the sinter layer is easier at a copper surface than at an aluminum surface. Apart from that, it is much easier to form the protrusions of the patterned object when the patterned object is basically made—e.g. excluding the inlay and any coating—of aluminum (including aluminum alloys) instead of copper. This especially applies if the protrusions are made by (stamp) forging. Further, it is easier to produce channels for cooling (e.g. for a coolant/refrigerant) within the patterned object when the latter is basically made of aluminum instead of copper.

The inlay may cover the attachment areas for several attachment objects. Additionally or alternatively, the patterned object may comprise various inlays made of copper for covering different attachment areas.

According to one aspect, the thickness of the deformation uptake means may be at least 0.5 mm, e.g. at least 1.0 mm. This reduces the risk that the longest protrusion penetrates completely through the whole thickness. Additionally or alternatively, the thickness may be 5 mm at the maximum, e.g. 4 mm at the maximum. This improves the heat transfer from the first tool side to the sintering material in the solidification step. Furthermore, this saves material and hence costs. Especially, the thickness of the deformation uptake means can be in the range from 1.0 mm to 3 mm.

According to another aspect, the patterned object is or comprises a heat dissipator, a heat sink, and/or (a part for) a cooler.

Additionally or alternatively, the attachment object is or comprises at least one of the following:

a heat generating component, an electronic component, e.g. a semiconductor component, and a semiconductor power module.

Especially, the attachment object may be the semiconductor power module. The semiconductor power module can include at least one semiconductor component.

The electronic component and the semiconductor power module generate heat during operation; hence they can be considered a heat generating component as well, respectively.

The semiconductor component can include or consist of a semiconductor switch, an insulated-gate bipolar transistor (IGBT), a metal-oxide-semiconductor field-effect transistor (MOSFET), and/or the like.

In particular, the attachment object can include or consist of a molded module. The molded module may be a semiconductor power module including a resin cover. The resin cover may be manufactured by transfer resin molding. If several attachment objects are fixed to the patterned object, at least one of them, a part of them, or all of them may include or consist of a molded module, respectively.

The semiconductor power module as such may include different layers and/or components.

The semiconductor power module may include any one of, several of, or all of the following:

an integrated heat spreader,
an insulation layer,
an (internal) circuit layer,
a fixation layer (e.g. an internal sinter layer) for fixing the semiconductor component to the insulation layer and/or the circuit layer,
the semiconductor component,
bonding wires, and
the resin cover ("molded module").

The insulation layer may be made of ceramic material. The (internal) circuit layer may be fixed to the insulation layer. Additionally or alternatively, the integrated heat spreader may be fixed to the insulation layer. The integrated heat spreader may be arranged at the interface side. The insulation layer may be provided between the integrated heat spreader and the (internal) circuit layer.

According to one aspect, the internal sinter layer is formed by pressure-sintering in the same solidification step as the sinter layer between the attachment object and the attachment side. In this way, forming the internal sinter layer for fixing the semiconductor component to the insulation layer and/or the circuit layer and forming the sinter layer between the attachment object and the attachment side by pressure-sintering can be made in a cost-efficient, timesaving, manufacturing-facilitating, synergistic manner. Accordingly, the fixation layer may be provided as (not yet solidified) sintering layer before the solidification step.

In one embodiment, the attachment object (e.g. the semiconductor power module) includes a direct bonded copper (DCB) structure. It may include a substrate, e.g. a ceramic substrate, that forms the insulation layer. Further, the DCB structure may include the insulation layer and one of or both of the (internal) circuit layer and the integrated heat spreader. The protrusions may be fins. The fins can include pin fins and/or oblong fins/ribs. The fins may be adapted for heat exchange, e.g. for heat release to an external fluid (like air).

A circumferential shape of the deformation uptake means may be adapted to a shape of the first tool side and/or to the handling means (if any). This facilitates proper alignment in the pressure-sintering tool.

The method may include reusing the deformation uptake means. For example, after one solidification step, the deformation uptake means may be turned upside down with respect to the first tool side. Another side of the deformation uptake means faces the protrusions of another patterned object in a new solidification step. Especially, the method can include reusing the deformation uptake means several times. It has been found out that remaining plastic indentations formed in the deformation uptake means during a former method cycle do not significantly impair the beneficial effect of the deformation uptake means, even if the side with the remaining indentations is used again for engaging tip portions in a new method cycle.

A basic shape of the deformation uptake means (or if the deformation uptake means includes separate elements like separate metal sheets, the individual basic shapes thereof) may be symmetric to a middle plane of the basic shape. Hence, the basic shape is invariant with regard to turning the deformation means (the separate elements) upside down.

Additionally or alternatively, the deformation uptake means may be recycled afterwards.

The method may further include manufacturing the protrusions of the patterned object by forging, for example by stamp forging. This allows cost-efficient and quick mass production. The method allows to compensate for the manufacturing tolerances. The patterned object with the protrusions formed by (stamp) forging can be employed without any post-processing of the protrusions for reducing their geometric tolerances. Without the disclosed method, the tip portions would have to be milled down after stamp forging in order to achieve the required low tolerance regarding the protrusion length. The manufacturing would be more complex and more expensive.

The above-mentioned problem is further solved by an assembly comprising an attachment object and a patterned object, wherein the attachment object is fixed to an attachment side of the patterned object by pressure-sintering, and wherein the patterned object comprises a patterned side facing away from the attachment side, the patterned side including a plurality of protrusions.

In one embodiment, a thickness of a sinter layer, which fixes the attachment object to the patterned object, is 70 μm at the maximum. Additionally or alternatively, the thickness of the sinter layer may be at least 20 μm. The thickness of the sinter layer can be 50 μm±W. W may be 10 μm or 6 μm, for example.

According to one aspect, a manufacturing tolerance regarding a protrusion length of the protrusions may be more than (worse than) 20 μm, in a modification more than 50 μm.

In one embodiment, the protrusions have been manufactured by stamp forging. In one embodiment, the protrusions must not be mechanically post-processed after stamp forging.

Additionally or alternatively, the patterned object may be formed in one piece.

The features and advantages described with respect to the method apply accordingly with respect to the assembly, and vice versa.

According to one aspect, the attachment object may have been (permanently) fixed to the patterned object with the method disclosed herein.

The assembly may be configured to be electrically connected to other electric and/or electronic components.

In one embodiment, the assembly is configured to form part of an electric circuit.

The assembly may be adapted to exhibit electric functionalities. For example, it may be adapted to switch electric currents.

The assembly can be configured to form part of a drivetrain circuit, e.g. in an electric vehicle. Electric vehicles may include electric cars, trucks, electric trains, marine vehicles (e.g. boats and ships), aircrafts, and/or the like. The drivetrain circuit can be a circuit for an electric motor, an electric drivetrain, a hybrid electric drivetrain, a battery electric drivetrain, and/or the like. For example, the assembly may be a multi-chip automotive traction power module. In general, the drivetrain circuit can be configured for mobile, semi-mobile, and/or stationary applications. For example, drivetrain circuits for compressors, ropeways, stationary cranes, pumps, and the like can be considered as well.

According to one aspect, the assembly is configured to form part of an inverter circuit. The assembly can be used in inverters, e.g. in the drivetrain circuit.

According to one aspect, the assembly is a half bridge power assembly.

Additional features, advantages and possible applications of the invention result from the following description of exemplary embodiments and the drawings. All the features described and/or illustrated graphically here form the subject matter of the invention, either alone or in any desired combination, regardless of how they are combined in the claims or in their references back to preceding claims.

BRIEF DESCRIPTION OF THE DRAWINGS

Preferred embodiments of the invention will now be described with reference to the drawings, in which.

DETAILED DESCRIPTION

Figure 1:
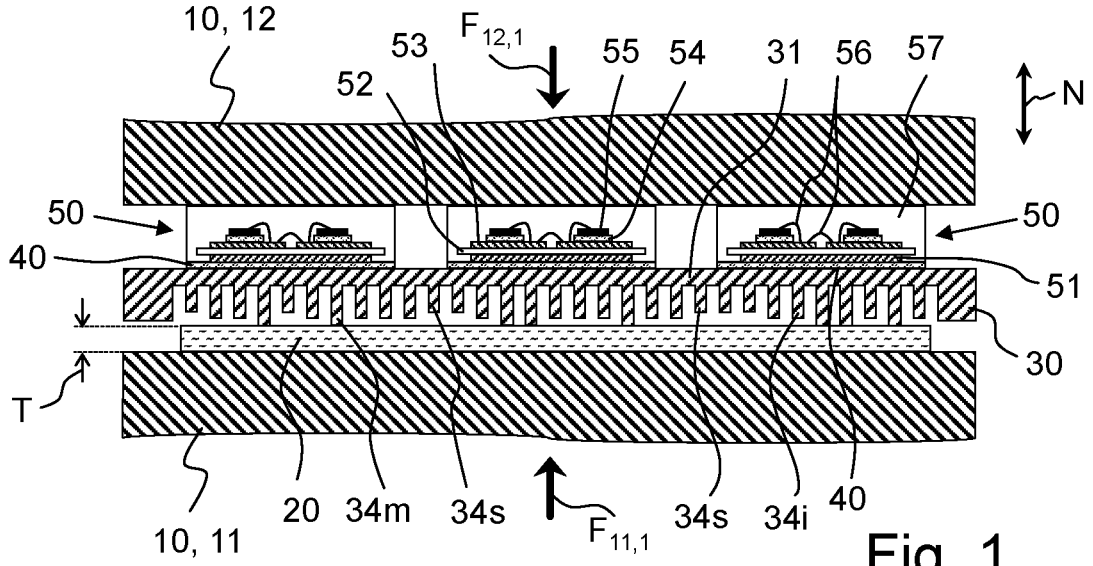
FIG. 1 shows a cross-sectional view of a collocation with a patterned object and several attachment objects in a pressure-sintering tool at a first stage of a solidification step for solidifying sintering material arranged between the attachment objects and the patterned object, wherein a deformation uptake means is provided between protrusions (pin fins) of the patterned object and a first tool side of the pressure-sintering tool, and wherein only the longest protrusions engage the deformation uptake means at the first stage.

FIG. 1 schematically shows a collocation for pressure-sintering in a pressure-sintering tool 10 at a first stage of a solidification step. In this example, the collocation includes one patterned object 30 and three attachment objects 50 that shall be fixed to an attachment side 32 of the patterned object 30 by pressure-sintering. Furthermore, the collocation includes sintering material 40. For each of the attachment objects 50, a corresponding section of sintering material 40 is provided between the respective attachment object 50 and the attachment side 32 of the patterned object 30. The attachment objects 50 become permanently fixed to the attachment side 32 of the patterned object 30 by the disclosed method.

The attachment side 32 of the patterned object 30 is substantially flat, at least in respective contact areas at which the attachment objects 50 become fixed. A normal direction N is perpendicular to said contact areas. In this example, the whole attachment side 32 is flat. Correspondingly, the normal direction N is perpendicular to the complete attachment side 32.

Before the situation shown in FIG. 1, i.e. before the solidification step is performed, the sintering material 40 is applied onto the attachment side 32. For each of the attachment objects 50, a corresponding section of sintering material 40 is applied. Additionally or alternatively, the sintering material 40 is applied onto interface sides of the attachment objects 50. The interface side of the respective attachment object 50 is its side facing the attachment side 32 in the solidification step. In FIG. 1, these are the lower sides of the attachment objects 50.

Figure 3:
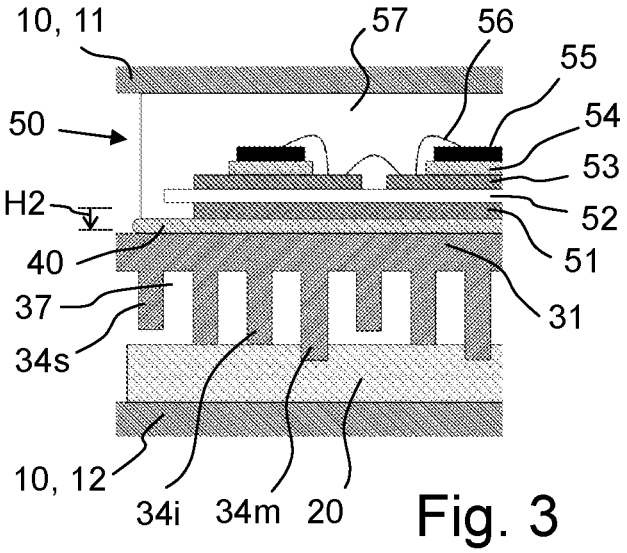
FIG. 3 shows an enlarged section of FIG. 2, showing that the longest protrusions have already plunged into the deformation uptake means, wherein the intermediate protrusions have started to abut and hence to engage the deformation uptake means such that the intermediate protrusions now also take part in transferring pressing forces between the first tool side, via the deformation uptake means, and the rest of the patterned object and thus the sintering material.

In FIG. 1, the areas of the sections of the sintering material 40 correspond to (a shape/size of) the interface side of the respective attachment object 50. It should be noted that pressurizing the sintering material has already begun in FIG. 1. It is also possible that the area of the respective section of the sintering material 40 is smaller than the interface side of the corresponding attachment object 50. This might especially apply before applying the forces F11, F12 starts. The sintering material 40 is squeezed during the solidification step. It might thus expand laterally (with respect to the normal direction N) while its height (along the normal direction N) is reduced. The area of the corresponding section of the sintering material 40 may even become larger than the interface side of the respective attachment object 50. This lateral expansion is schematically illustrated in FIG. 3.

The sintering material 40 can include sintering paste. Additionally or alternatively, it can include one or more sintering pads. The sintering material 40 can include a volatile organic component and silver particles. It may be applied "wet".

The method can further include pre-drying the applied sintering material 40 before the solidification step. During the pre-drying, the volatile organic component at least partly evaporates. In particular, pre-drying can be performed before the attachment objects 50 are placed at the attachment side 32 with the sintering material 40 in between. The pre-drying can be performed outside of the pressure-sintering tool 10.

Figure 6:
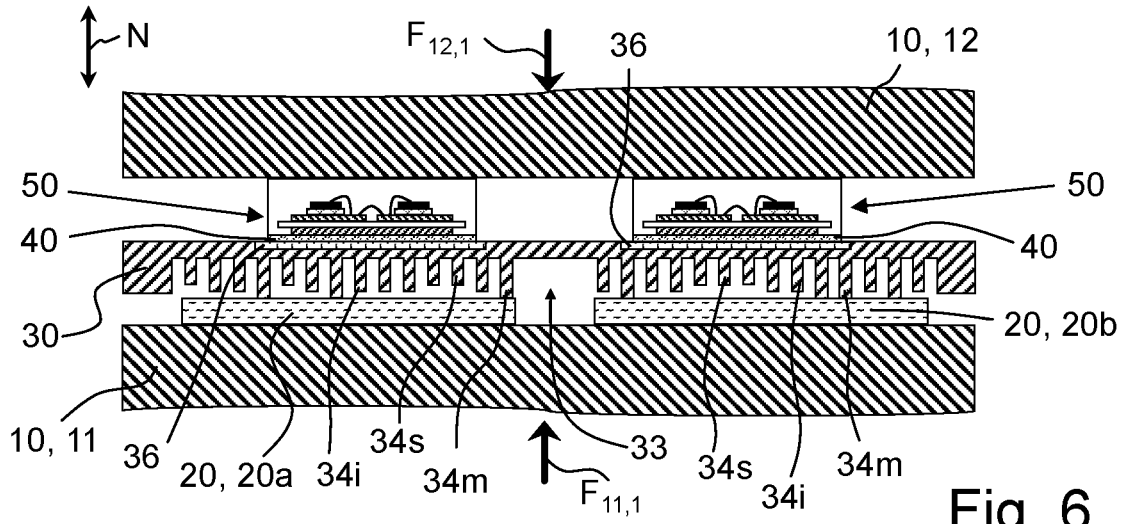
FIG. 6 shows a first stage of a solidification step similar as in FIG. 1 in a pressure-sintering method, wherein two attachment objects are provided and wherein the deformation uptake means includes two separate elements, one for each of the attachment objects.

In the examples shown in FIG. 1 and FIG. 6, the attachment objects 50 are semiconductor power modules, more precisely molded modules. They can be of the same type or of different types.

In this example, each attachment object 50 comprises a direct bonded copper (DCB) structure with a ceramic insulation layer 52, an integrated heat spreader 51, and an internal circuit layer 53. The integrated heat spreader 51 is arranged at the interface side of the attachment object 50. The integrated heat spreader 51 is formed on one side of the insulation layer 52 and fixed to the latter. The internal circuit layer 53 is formed on and fixed to an opposite side of the insulation layer 52 (e.g. the upper side in FIG. 3). Semiconductor components 55 are fixed to the internal circuit layer 53 by internal sinter layers 54. The internal sinter layers 54 may include separate sections for each of the semiconductor components 55. The semiconductor components 55 can include, for example, IGBTs and/or MOSFETs. The semiconductor power modules can further comprise bonding wires 56 and/or other means for electrically connecting the semiconductor components 55.

According to one aspect, (at least some of) the internal sinter layers 54 can be formed from sintering material by solidification in the same solidification step as a sinter layer that is formed from the sintering material 40.

However, in the exemplary embodiments shown, the attachment objects 50 are molded (semiconductor power) modules. The internal sinter layers 54 are already sintered. Each molded module comprises a resin cover 57. The resin cover 57 covers the whole semiconductor power module except the integrated heat spreader 51 at the interface side. The resin cover 57 exhibits electrical insulation, protection against humidity as well as protection against mechanical and chemical damage.

The attachment side 32 of the patterned object 30 is substantially flat, at least in contact areas at which the attachment objects 50 become fixed. The normal direction N is perpendicular to said contact areas. In this example, the whole attachment side 32 is flat. Correspondingly, the normal direction N is perpendicular to the complete attachment side 32.

The patterned object 30 comprises a planar main plate 31, which (at least substantially) extends perpendicular to the normal direction N. One end side of the main plate 31 along the normal direction N is the attachment side 32. A side opposite to the attachment side 32 is a patterned side 33. The patterned side 33 comprises a plurality of protrusions 34. The protrusions 34 protrude along the normal direction N from the main plate 31.

Figure 7:
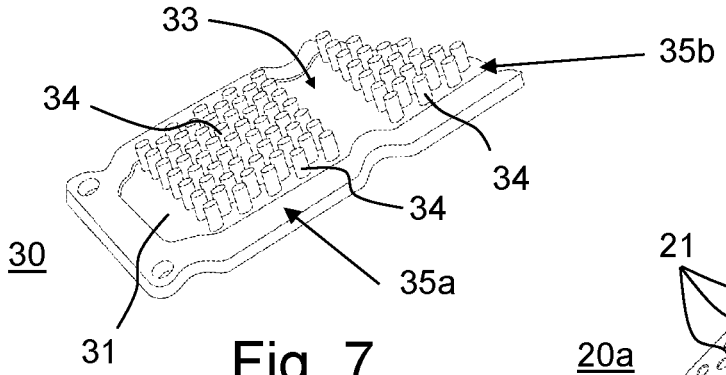
FIG. 7 shows a perspective view of a patterned side of the patterned object with the protrusion (pin fins)

In this exemplary embodiment, all protrusions 34 are formed as pin fins. The pin fins can be seen best in FIG. 7. As indicated in FIG. 3, the pin fins are distanced from each other in lateral directions (directions perpendicular to the normal direction N), wherein empty spaces 37 are formed between adjacent pin fins.

Alternatively or in addition, protrusions with other shapes can be formed at the patterned side 33. For example, such other shapes can include oblong fins (e.g. cooling ribs).

In this exemplary embodiment, the patterned object 30 is a heat sink. It is configured to take up heat from the attachment objects 50 during operation, to spread the heat and further dissipate it by the protrusions (pin fins) 34 to an environmental fluid, e.g. air.

Additionally or alternatively, the patterned side 33 may include a channel structure for guiding fluid, e.g. a coolant. The patterned object 30 can be a cooler or a component for forming a substantial part of a cooler ("a part for a cooler"). For example, the patterned object 30 can include or consist of a metal layer with an internal structure for a flow distributor, e.g. according to any one of the embodiments disclosed in EP 2 559 063 Bi. In this context, the inner walls of the metal layer can be considered protrusions 34.

Figure 4:
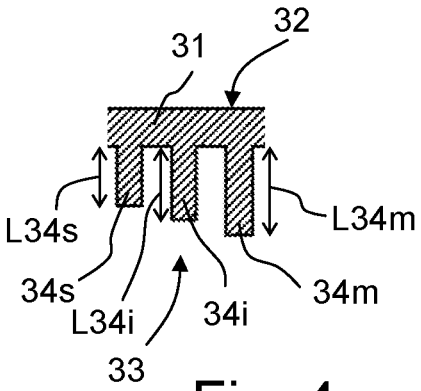
FIG. 4 shows an enlarged section of the patterned object for schematically illustrating different protrusion lengths of the longest protrusions, the intermediate protrusions, and shortest protrusions.

In the shown embodiments, the protrusions (pin fins) 34 at the patterned side 33 are produced by stamp forging. They are not subjected to additional mechanical postprocessing, e.g. milling, for improving a manufacturing tolerance regarding protrusion lengths of the protrusions 34. Therefore, the protrusion lengths along the normal direction N vary. In FIGS. 1 to 6, this is schematically illustrated by showing longest protrusions **34*m* having a longest protrusion length L34*m* (a maximum protrusion length L34*m*), intermediate protrusions 34*i* having an intermediate protrusion length L34*i*, and shortest protrusion 34*s* having a shortest protrusion length L34*s*. This can be seen best in FIG. 4 illustrating an enlarged section of FIG. 2**. It is understood that the protrusion lengths can actually vary according to a statistical distribution. Accordingly, there are more different individual protrusion lengths. However, the simplified explanation facilitates the understanding.

The patterned object 30 can be made of copper, e.g. of a copper-based alloy. Copper and copper-based alloys facilitate a strong and reliable fixation of the sinter layer formed from the sintering material 40. At least the protrusions 34 might be coated with a coating, e.g. with a nickel coating (including coatings made of nickel-based alloys).

Alternatively, the patterned object 30 is basically made of aluminum, e.g. of an aluminum alloy. This facilitates producing the protrusions 34 by stamp forging. Optionally, the patterned object 30 may include at least one inlay 36 at the attachment side 32 where the attachment objects 50 are fixed. The inlay(s) 36 may be made of copper, e.g. of a copper-based alloy. As noted above, this facilitates strong and reliable fixation of the sinter layer. Furthermore, copper has a particularly high heat conduction. The heat taken up from the attachment objects 50 via the sinter layer is efficiently pre-dissipated within the patterned object 30 by the inlay(s) 36. FIG. 6 shows two of such inlays 36. Inlays are described in WO 2020/254143 A1.

The pressure-sintering tool 10 comprises a first tool side 11 and a second tool side 12. The first tool side 11 and the second tool side 12 are configured to apply forces $F_{11}$ and $F_{12}$ for pressing the attachment objects 50 and the patterned object 30 towards each other along the normal direction N. In FIG. 1, upper sides (resin sides) of the attachment objects 50 directly abut the second tool side 12. It is expected that the absolute values of the forces $F_{11}$ and $F_{12}$ are at least substantially the same.

Conventionally (not shown), the patterned side 33 of the patterned object 30 directly abuts the first tool side 11. Only the tip portions of the longest protrusions **34*m* (those with the longest protrusion length L34*m*) abut on and engage the first tool side 11. The first tool side 11 must be hard and strong, e.g. have a high hardness and a high yield strength, because the pressure-sintering tool 10 must not be damaged during the solidification step. The pressure-sintering tool 10 must be reliable, long-lasting, and usable for performing a large plurality of solidification steps. Hence, the first tool side 11** must not yield, at least not plastically, in the course of the solidification step.

As a consequence, in conventional pressure-sintering (not shown), the force $F_{11}$ applied by the first tool side 11 is transferred to the main plate 31 of the patterned object 30 exclusively via the longest protrusions 34*m*. The intermediate protrusions 34*i* and the shortest protrusions 34*s* are not involved in the force transfer. This results in excessive local stresses and deformations of the patterned object 30 during the solidification step. The attachment side 32 can locally bulge. This leads to variations of the pressure applied to the sintering material 40 and to local variations of the sintering quality.

In addition, depending on a spatial distribution of the longest protrusions 34*m* laterally to the normal direction N and/or due to different thicknesses of the attachment objects 50 (along the normal direction N), it can happen that the patterned object 30 (especially its attachment side 32) is not aligned properly perpendicularly to the normal direction N during the solidification step. This results in global thickness variations of the sinter layer. For example, at least a section of the sinter layer for one of the attachment objects 50 may have a cross-sectional shape (in a plane parallel to the normal direction) that is more similar to a trapezoid, e.g. a right trapezoid, than to a rectangle. Additionally, the thickness of the sinter layer may vary for the different sections for the different attachment objects 50.

According to the present invention and as shown in FIG. 1, an additional deformation uptake means 20 is arranged between the first tool side 11 and the patterned object 30. The deformation uptake means 20 compensates manufacturing tolerances, e.g. the manufacturing tolerance regarding the protrusion lengths, and other tolerances, especially tolerances along the normal direction N ("height tolerances"). Such height tolerances can include differences in the thicknesses of the attachment objects 50, unevenness of the first tool side 11 and/or the second tool side 12, height tolerances of additional fixation means (not shown) for fixing the collocation in the sintering tool 10, and the like.

The deformational uptake means 20 partially deforms during the solidification step in order to allow more and more of the protrusions 34 to engage with the deformation uptake means 20 while the pressure applied on the sintering material 40 is increased.

The deformation uptake means 20 is made of a deformation material. The deformation uptake means 20 is softer than the first tool side 11 and softer than the protrusions 34. In the exemplary embodiment shown in FIG. 1, the deformation uptake means 20 is a single metal sheet having a thickness T in the range from 1 mm to 4 mm, e.g. 2 mm. Especially, its yield strength is lower than the one of the protrusions 34, for example 80% at the most or even 60% at the most. Additionally or alternatively, its hardness is lower than the one of the protrusions 34, for example 80% at the most or even only 60% at the most. Its yield strength and hardness can be also lower than those of a material of the first tool side 11, for example by at least 40%.

Further, the exemplary deformation uptake means 20 shown in FIG. 1 is made of pure aluminum. Pure aluminum may mean aluminum with a purity of at least 99.0 weight %, e.g. with 99.5 weight %. This deformation material exhibits low hardness and low yield strength. In more detail, the deformation material can be aluminum EN AW 1050A. It can be in the "H111/0" temper condition.

The pure aluminum exhibits sufficient heat conduction for applying heat to the sintering material 40 in the solidification step and is chemically stable at an elevated sintering temperature.

If the patterned object 30, especially its protrusions 34 are made of aluminum, this kind of aluminum has a higher yield strength and hardness than the pure aluminum. For example, the aluminum used for the attachment object 50 is aluminum with less purity, e.g. an aluminum alloy, and/or it is of another temper condition. In every case, it exhibits higher yield strength and hardness than the pure aluminum used as the deformation material.

FIG. 1 shows a situation in a first stage of the solidification step. Tool-facing sides (upper sides in FIG. 1) of the attachment objects 50 directly abut the second tool side 12. One large flat surface (a lower side in FIG. 1) of the deformation uptake means 20 directly abuts the first tool side 11. The patterned side 33 of the patterned object 30 directly abuts the other large flat surface of the deformation uptake means 20 (an upper side in FIG. 1).

In the first stage of the solidification step shown in FIG. 1, the forces $F_{11}$ applied by the first tool side 11 and $F_{12}$ applied by the second tool side 12 for pressing the attachment objects 50 and the patterned object 30 towards each other (along the normal direction N) have reached first levels $F_{11,1}$ and $F_{12,1}$. Only the tip portions of the longest protrusions 34*m* directly abut and hence engage the deformation uptake means 20. At this first stage, the complete force $F_{11,1}$ is transferred from the deformation uptake means 20 to the main plate 31 of the patterned object 30 and hence to the sintering material 40 via the longest protrusions 34*m*. During the first stage, neither the intermediate protrusions 34*i* nor the shortest protrusions 34*s* do contribute to said force transfer. The tip portions of the intermediate protrusions 34*i* and the shortest protrusions 34*s* do not abut and hence do not engage the deformation uptake means 20 during the first stage.

If the forces $F_{11}$ and $F_{12}$ are increased further, stresses at the engagement areas of the deformation uptake means 20 with the tip portions of the longest protrusions 34*m* rise. At first, the deformation uptake means 20 yields (at least predominantly) elastically. When the stresses at the engagement areas exceed a certain threshold, the deformation uptake means 20 yields plastically at the corresponding engagement areas. The deformation material starts to plastically flow around the corresponding tip portions and these tip portions plunge into the deformation uptake means 20 further with local plastic deformation of the latter at the corresponding engagement areas.

Figure 2:
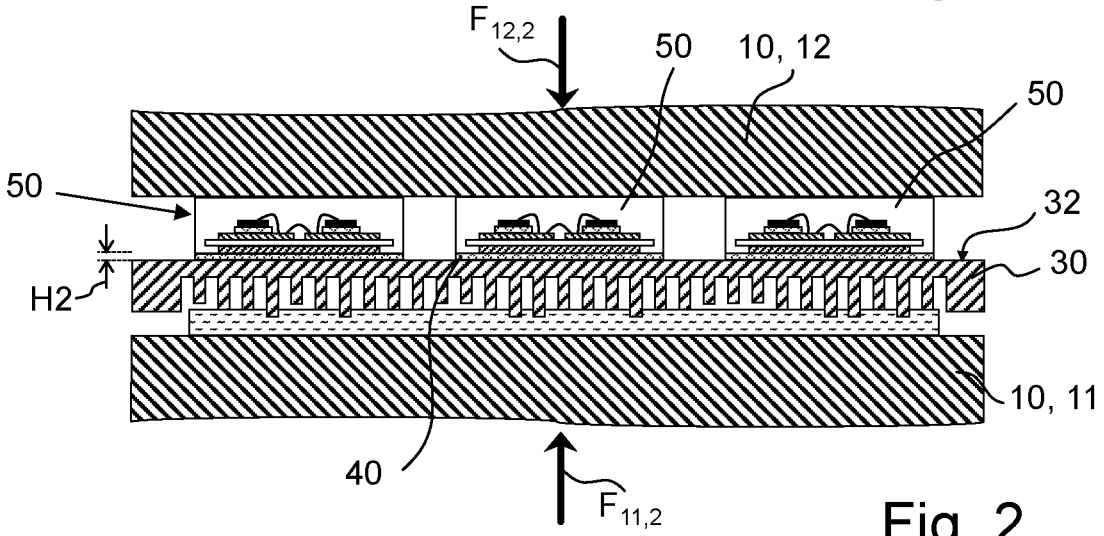
FIG. 2 shows a later, second stage of the same solidification step, wherein forces applied by the pressure-sintering tool for pressing the patterned object and the attachments objects towards each other for applying pressure on the sintering material arranged between have become high enough such that the longest protrusion of the patterned object have started to plunge into the deformation uptake means, wherein tip portions of intermediate protrusions with an intermediate protrusion length have started to additionally engage the deformation uptake means.

FIG. 2 shows a second stage of the solidification step. The forces $F_{11}$ and $F_{12}$ have reached second levels $F_{11,2}$ and $F_{12,2}$ that are higher than the corresponding first levels $F_{11,1}$ and $F_{12,1}$. The tip portions of the longest protrusions 34*m* have already plunged into the deformation uptake means 20 to a certain extent with plastic deformation.

Compared to the first stage shown in FIG. 1, the first tool side 11 and the deformation uptake means 20 on the one hand and the patterned object 30 at the other hand have been displaced along the normal direction N towards each other by a second stage distance H2.

Naturally, the tip portions of the longest protrusions 34*m* continue to engage the deformation uptake means 20. Now, the tip portions of the intermediate protrusions 34*i* have additionally come into direct contact with the deformation uptake means 20. They additionally abut and hence additionally engage the deformation uptake means 20 now. In other words, additional engagement areas are formed between the deformation uptake means 20 and tip portions, which are different from the longest protrusions 34*m*. From now on, the intermediate protrusions 34*i* additionally contribute to the transfer of the force $F_{11}$ from the first tool side 11 to the rest of the patterned object (particularly to the main plate 31) and hence to the sintering material 40. This prevents that excessive loads are applied onto the longest protrusions 34*m* only.

Figure 5:
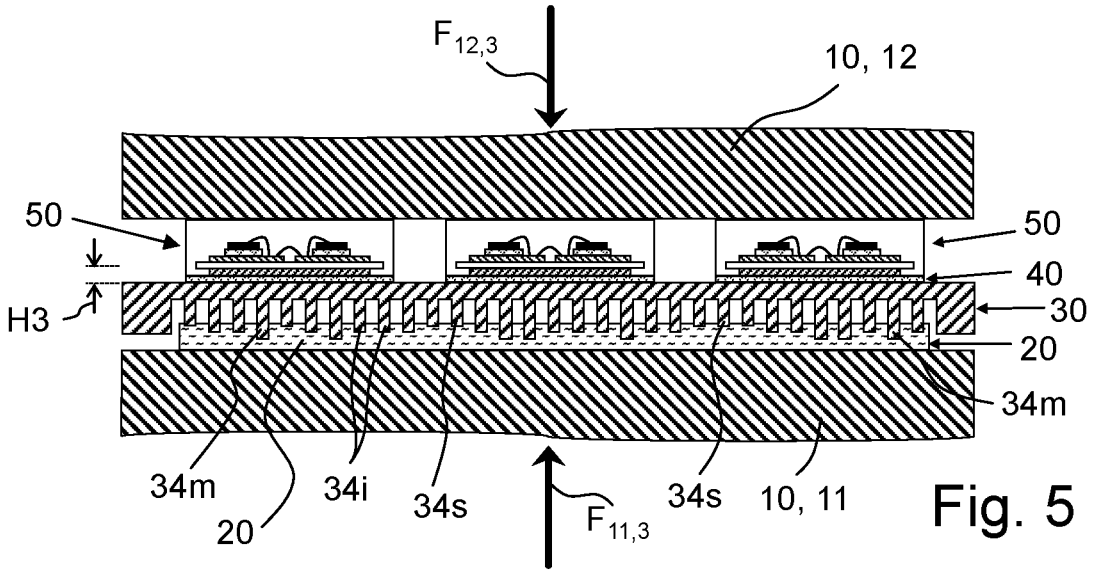
FIG. 5 shows a third stage of the same solidification step, wherein the forces applied by the pressure-sintering tool have become high enough that all protrusions, even the shortest protrusions, engage the deformation uptake means and are plunged into the deformation uptake means.

FIG. 5 shows a third stage of the solidification step. The forces $F_{11}$ and $F_{12}$ have reached third levels $F_{11,3}$ and $F_{12,3}$ that are higher than the corresponding second levels $F_{11,2}$ and $F_{12,2}$. The third stage may correspond to a maximum pressure application in the solidification step. In other words, $F_{11,3}$ may be a maximum level of the force $F_{11}$ applied during the solidification step and $F_{12,3}$ may be a maximum level of the force $F_{12}$ applied during the solidification step.

The tip portions of the intermediate protrusions 34*i* have also plunged into the deformation uptake means 20 to a certain extent with plastic deformation. Even the tip portions of the shortest protrusions 34*s* have plunged into the deformation uptake means 20 with plastic deformation. Naturally, the tip portions of the shortest protrusions 34*s* are not plunged as deep into the deformation uptake means 20 as the tip portions of the intermediate protrusions 34*i* and the tip portions of the intermediate protrusions 34*i* are not plunged as deep into the deformation uptake means 20 as the tip portions of the longest protrusions 34*m*.

Compared to the first stage shown in FIG. 1, the first tool side 11 and the deformation uptake means 20 on the one hand and the patterned object 30 at the other hand have been displaced along the normal direction N towards each other by a third stage distance H3. The third stage distance H3 is larger than the second stage distance H2 shown in FIG. 2.

Although the maximum pressure in the solidification step is reached in FIG. 5, the deformation uptake means 20 is strong and rigid enough such that the tip portions of the longest protrusions 34*m* do not protrude completely through the deformation uptake means 20. The thickness T of the deformation uptake material and the hardness and yield strength of the deformation material are high enough to prevent this. Even in FIG. 5, there is no direct contact between the tip portions of the longest protrusions 34*m* and the first tool side 11.

In FIG. 5, the tip portions of all the protrusions 34 (including the longest protrusions 34*m*, the intermediate protrusions 34*i*, and the shortest protrusions 34*s*) engage with deformation uptake means 30. As plastic deformation of the deformation uptake means 20 occurs at the engagement areas of all tip portions, all protrusions 34 bear at least substantially the same portions of the force $F_{11,3}$. The plastic deformations in the engagement areas ensure that no excessive load transfer is carried by some individual protrusions, e.g. the longest protrusions 34*m*. This allows compensating various height tolerances while ensuring more uniform stresses within the patterned object 30 and more uniform pressure application onto the sintering material.

The protrusions 34 do not plastically deform during the solidification step.

During the solidification step, the sintering material is not only subjected to the high pressure. In addition, the sintering tool 10 also heats up the sintering material 40 to the elevated sintering temperature. For example, the solidification step may include applying the elevated sintering temperature in a temperature range from 200° C. to 300° C. and the pressure in the range from 10 to 40 MPa to the sintering material 40 for a sintering time. The sintering time may be at least 2 minutes in order to ensure proper sintering of the whole sintering material 40. Additionally or alternatively, the sintering time may be 10 minutes at the maximum in order to reduce a risk of thermal degradation of the sinter layer formed from the sintering material 40 and/or of the attachment objects 50. Furthermore, shorter sintering times reduce the costs for heating and allow faster production.

The heat application from the second tool side 12 is limited in order not to risk thermal damage of the attachment objects 50. As the deformation uptake means 20 exhibits high heat conduction, the sintering material 40 can be heated up quickly by applying a majority of the heat from the first tool side 11.

FIG. 6 shows a slightly different arrangement. In this case, the deformation uptake means 20 consists of a separate metal sheet 20*a*, 20*b* for each of the attachment objects 50. The first metal sheet 20*a* covers a first set 35*a* of protrusions (pin fins) 34 for a first one of the attachment objects 50 and the second metal sheet 20*b* covers a second set 35*b* of protrusions (pin fins) 34 for a second one of the attachment objects. Apart from that, the description with regard to the arrangement and method described with respect to the other figures applies accordingly and the same reference numbers are used for the same element. For example, both metal sheets 20*a*, 20*b* can be made of pure aluminum.

In general, the method can be performed with other numbers of attachment objects 50 and other numbers of patterned objects 30 as well. For example, only one attachment object 50 may be fixed to the patterned object 30. In another modification, there are three attachments objects 50 and three corresponding separate metal sheets 20*a*, 20*b*.

Figure 8:
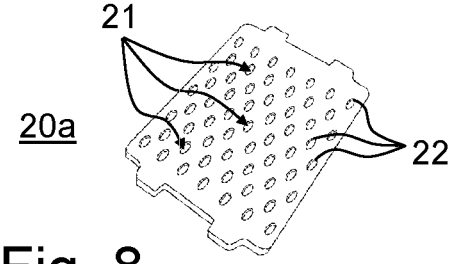
FIG. 8 show a perspective view of one of the elements of the deformation uptake means shown in FIG. 6 after the end of the solidification step, wherein the shown side exhibits a plurality of indentations caused by the protrusions plunging into the deformation uptake means with local plastic deformation of the latter during the solidification step.

As shown in FIG. 8 for one of the metal sheets 20*a*, the large flat surface of the deformation uptake means 20 facing the patterned object 30 in the solidification step includes a plurality of permanent indentations 21 after the solidification step has been finished. The indentations 21 result from the plastic deformation at the engagement areas caused by the tip portions of the protrusions 34. In this example, the tip portions of all protrusions 34 of the first set 35*a* have plunged into the metal sheet 20*a* with plastic deformation.

It is possible that the deformation uptake means 20 covers (overlaps with) only a fraction of all protrusions 34 in the solidification step. For example, in a modification of FIG. 6 (not shown), the metal sheet 20*a* does not overlap the three most left columns of the protrusions 34 and the metal sheet 20*b* does not overlap the three most right columns of the protrusions 34. There is also no overlap of the protrusions 34 with any one of the attachment objects 50 in those regions and hence these regions are less relevant for transferring the force $F_{11}$. According to one aspect, when referring to a projection in a plane perpendicular to the normal direction N, the deformation uptake means 20 overlaps the protrusions 34 at least in regions where the protrusions 34 overlap the attachment objects 50.

There are several approaches for quantifying how much percent of the tip portions have plunged into the deformation uptake means 20 with plastic deformation in the solidification step.

For example, it can be referred to a percentage of a number of the indentations 21 (as shown in FIG. 8), which remain from the last solidification step, relative to a total number of the protrusions 34 (indication in number %). In FIG. 8 and assuming that the metal sheet 20*b* looks accordingly, this indication would be 100 number %.

Another approach is to sum up opening areas 22 (unit: $m^2$ or the like) of all indentations 21 in the deformation uptake means 20, resulting in an area $A_{p1}$. In FIG. 8, the opening areas 22 are the areas of the oval openings of the indentations 21 at the upper surface of the metal sheet 20*a*. A reference value $A_{ref}$ can be a sum of cross-sectional areas of all of the tip portions in a cross-sectional plane perpendicular to the normal direction N. $A_{ref}$ may be simply calculated by assuming an ideal patterned object 34 without tolerances. Said cross-sectional plane can be assumed at a position where all of the tip portions (if applicable, all those of the fraction covered by the deformation uptake means 20) are plunged into the deformation uptake means 20 by at least 40 μm. In this case, a final value 'R'=$A_{p1}/A_{ref}$·100% corresponds to an indication in area %. This approach can be more precise especially in cases where the patterned object 30 includes protrusions 34 with different and/or complex shapes.

The deformation uptake means 20 can be re-used. For example, when the solidification step is finished and when an assembly, which is formed by fixing the attachment objects 50 to the patterned object 30 by pressure-sintering, is taken out of the sintering tool. The deformation uptake means 20 is simply turned upside down and re-used for a new method cycle, in which new attachment objects 50 are fixed to a new patterned object 30.

When the solidification step is finished, the sintering material 40 has been transformed to a sinter layer. The resulting assembly includes the patterned object 30, the attachment objects 50, and the sinter layer in-between. The sinter layer permanently fixes the attachment objects 50 to the patterned object 30. With the disclosed method, a very thin and uniform sinter layer is produced, despite of the height tolerances. This allows easier and more cost-efficient production of the patterned object 30. The thin and uniform sinter layer exhibits particularly good heat conduction from the attachment objects 50 to the patterned object 30 and particularly high reliability.

Figure 9:
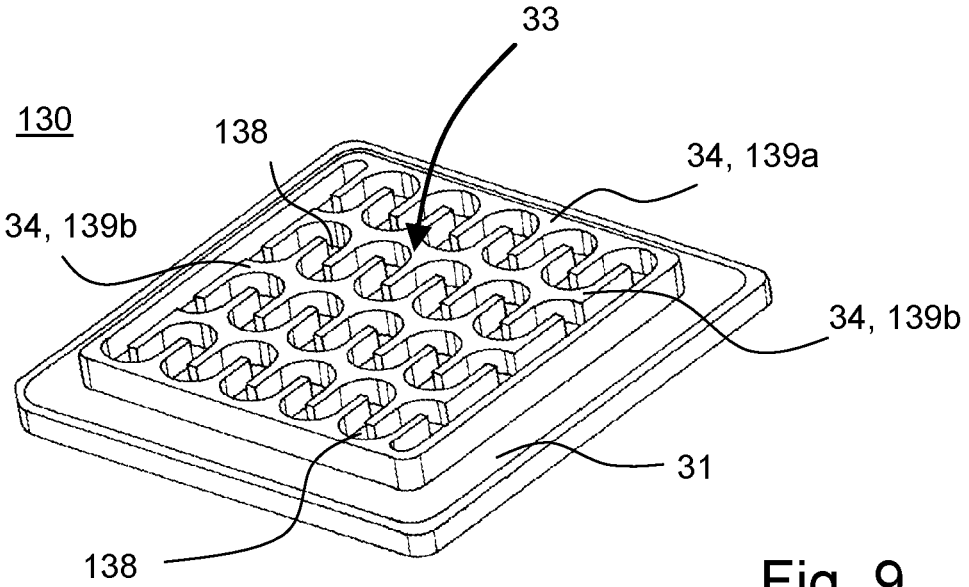
FIG. 9 shows a perspective view onto a patterned side of another embodiment of a patterned object, wherein the protrusions form flow channels for a coolant such that this patterned object is configured for forming a substantial part of a cooler.

FIG. 9 shows another embodiment of a patterned object 130 that is known from DE 10 2017 101 126 A1. In this case, the protrusions 34 form a wall structure on the patterned side 33 of the main plate 31. In more details, the protrusions 34 form a cooling structure with flow channels 138 for guiding a coolant. The cooling structure includes an outer wall structure 139*a* and a plurality of inner walls 139*b*, wherein the inner walls 139*b* (and also parts of the outer wall structure 139*a*) are arranged to exhibit an interleaved comb pattern for guiding a flow of the coolant along the cooling structure. A cooler can be completed by covering and sealing the cooling structure at the patterned side 33, e.g. with a cover plate (not shown). By this, the channels 138 can be closed.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for fixing an attachment object to a patterned object by pressure-sintering, wherein the attachment object becomes fixed to an attachment side of the patterned object and wherein the patterned object comprises a patterned side facing away from the attachment side, the patterned side including a plurality of protrusions with tip portions, the method including:

providing a sintering material between the attachment object and the attachment side of the patterned object;

arranging the patterned object and the attachment object in a sintering tool, wherein the patterned object is arranged at a first tool side of the sintering tool and the attachment object is arranged at a second tool side of the sintering tool;

arranging a deformation uptake means between the first tool side and at least a fraction of the tip portions, wherein the deformation uptake means is made of a deformation material having a lower yield strength and/or a lower hardness than the tip portions;

a solidification step including pressing the patterned object and the attachment object towards each other for densifying the sintering material and applying heat to the sintering material, thereby sintering the sintering material, forming a sinter layer between the attachment side and the attachment object and forming an assembly comprising the attachment object and the patterned object; and removing the deformation uptake means from the assembly.

2. The method according to claim 1, further including plastically deforming the deformation uptake means locally by pressing the deformation uptake means against the patterned object at its patterned side.

3. The method according to claim 1, including plunging at least 20 number-% and/or at least 20 area-% of the tip portions into the deformation uptake means causing local plastic deformation of the deformation uptake means during the solidification step and/or an adaption step preceding the solidification step, by pressing the deformation uptake means against the patterned object at its patterned side.

4. The method according to claim 1, wherein the fraction of the tip portions corresponds to at least 50% of all of the tip portions.

5. The method according to claim 1, wherein a yield strength of the deformation material is at the most 80% of a yield strength of the protrusions.

6. The method according to claim 1, wherein a hardness of the deformation material is at the most 80% of a hardness of the tip portions.

7. The method according to claim 1, wherein the deformation material has a thermal conductivity of at least 30 W/(m·K).

8. The method according to claim 1, wherein the deformation uptake means includes a metal sheet.

9. The method according to claim 1 wherein the deformation material is aluminum with a purity of at least 99.0 weight-%.

10. The method according to claim 1, wherein the yield strength of the deformation material is at least 8 MPa.

11. The method according to claim 1, wherein an elevated sintering temperature is in the range from 200° C. to 300° C. and wherein the deformation material is stable at the elevated sintering temperature.

12. The method according to claim 1, wherein at least cores of the protrusions are made of copper and/or aluminum.

13. The method according to claim 1, wherein a thickness of the deformation uptake means is in the range from 0.5 mm to 5 mm.

14. The method according to claim 1, wherein the patterned object is or comprises a heat dissipator, a heat sink, and/or a part for a cooler, and wherein the attachment object is or comprises at least one of the following:

a heat generating component,
an electronic component, and
a semiconductor power module.

15. The method according to claim 1, wherein the protrusions are fins.

* * * * *